US010532389B2

(12) United States Patent
Del Fabro

(10) Patent No.: US 10,532,389 B2
(45) Date of Patent: Jan. 14, 2020

(54) BENDING MACHINE AND CORRESPONDING METHOD

(71) Applicant: M.E.P. Macchine Elettroniche Piegatrici Spa, Reana Del Rojale (IT)

(72) Inventor: Giorgio Del Fabro, Udine (IT)

(73) Assignee: M.E.P. Macchine Elettroniche Piegatrici Spa, Reana Del Rojale (IT)

( * ) Notice: Subject to any disclaimer, the term of this patent is extended or adjusted under 35 U.S.C. 154(b) by 0 days.

(21) Appl. No.: 15/316,834

(22) PCT Filed: Jun. 5, 2015

(86) PCT No.: PCT/IB2015/054277

§ 371 (c)(1),
(2) Date: Dec. 6, 2016

(87) PCT Pub. No.: WO2015/186112

PCT Pub. Date: Dec. 10, 2015

(65) Prior Publication Data

US 2017/0113258 A1 Apr. 27, 2017

(30) Foreign Application Priority Data

Jun. 6, 2014 (IT) ..... UD2014A0097

(51) Int. Cl.
*B21D 11/12* (2006.01)
*B21D 7/022* (2006.01)

(52) U.S. Cl.
CPC ..... *B21D 11/12* (2013.01); *B21D 7/022* (2013.01)

(58) Field of Classification Search
CPC ..... B21D 7/022; B21D 7/024; B21D 11/00; B21D 11/12
See application file for complete search history.

(56) References Cited

U.S. PATENT DOCUMENTS 5,927,132 A 7/1999 Rupoli
2014/0000335 A1* 1/2014 Fries ..... B21D 7/024 72/362

FOREIGN PATENT DOCUMENTS

DE 3301061 A1 4/1984
DE 9406880 U1 7/1994
EP 0 715 907 A1 6/1996
FR 2 704 784 A3 11/1994
JP 58-209424 12/1983
JP 10-192991 A 7/1998
JP 10192991 A * 7/1998

(Continued)

OTHER PUBLICATIONS

Machine translation of JP 10-192991 A, Osada, pp. 1-4, translated on Mar. 24, 2018.*

(Continued)

*Primary Examiner* — Teresa M Ekiert
(74) *Attorney, Agent, or Firm* — Lynda L. Calderone; Calderone Bullock, LLC

(57) ABSTRACT

Perfected curving machine comprising a support bench configured to simultaneously support one or more bars, wherein said support bench has an oblong development in relation to the length of the bars, and comprises at least one bending unit controllably mobile along the support bench in order to bend said bars, and clamping means configured to constrain the position of the bars on the support bench.

13 Claims, 5 Drawing Sheets

(56) References Cited

FOREIGN PATENT DOCUMENTS

| | | | |
|---|---|---|---|
| JP | 2003-117612 | A | 4/2003 |
| JP | 2009-012029 | A | 1/2009 |
| WO | WO 03/082492 | A1 | 10/2003 |

OTHER PUBLICATIONS

International Search Report and Written Opinion, dated May 10, 2015, 8 pages.

* cited by examiner

BENDING MACHINE AND CORRESPONDING METHOD

BACKGROUND OF THE INVENTION

Field of the Invention

The present invention concerns a perfected curving machine, and also the corresponding method for curving reinforcement rods.

The perfected curving machine and the corresponding method serve to make curved reinforcement rods with desired radiuses of curvature.

Description of Related Art

Curving machines for reinforcement rods are known, that is, rods used to reinforce reinforced concrete.

It is known that, in the case of circular or semi-circular platforms, the reinforcement rods must be shaped in direct coordination with the profile of the platform to be made.

Reinforcement rods can have a round section, a round section with ridges or ribs able to reinforce the anchorage with the concrete, a square or similar section, or a rectangular section.

Reinforcement rods are usually connected to each other by stirrups to create the desired reinforcement structures.

It is also known that for curved reinforcement structures with a big diameter, segments of reinforcement rods are shaped to create, for example by stirrups, in loco or in the place of shaping, the reinforcements to be anchored or integrated in the cast of concrete.

Curving machines are known with a substantially horizontal flat panel, but these have problems in manipulating both the segments of rod to be curved and also the forming arcs of the circle.

These problems affect both the safety of the operators and also the physical condition of the bars, which are subjected to possible deformations. It has also been tried to solve these problems by disposing a plurality of benches at entrance to and exit from the curving machine.

On the one hand this strategy solves some problems, such as those connected with supporting the stirrups shaped as an are of a circle, but on the other hand it is not easily practicable when two or more bars are being worked simultaneously.

In this case, the bars remain reciprocally positioned only in cooperation with the bending unit, but downstream and upstream they tend to collapse.

If one or more bars collapse upstream of the bending unit, there can easily be a twisting of the bars in the bending unit. In this case, problems can be created both for the bending unit, and for the operator, and for the bars involved.

BRIEF SUMMARY OF THE INVENTION

The present invention has been devised, tested and embodied in order to simplify the operations of shaping one or more bars in an arc of a circle, or in other curves.

In fact, the present invention allows to obtain bars shaped in an arc of a circle, or with rectilinear segments and curved segments, or spiral or elliptical or in an arc of a circle with at least two diameters.

The purpose of the present invention is therefore to simplify the production of shaped bars conformed as an arc of a circle or as a circle, preventing dangers for the operators, organizational and operating complications, quality and constancy of the product and variability of the curvature.

The present invention is set forth and characterized in the independent claims, while the dependent claims describe other characteristics of the invention or variants to the main inventive idea.

According to the invention, a perfected curving machine provides a support bench, with a mainly longitudinal development, on which the bars to be worked are disposed.

Clamping means are provided in a desired position on the bending bench, and are configured to selectively clamp the position of the bars to be worked.

The support bench can have a length substantially coordinated with the length of the bars that are worked on each occasion.

The perfected curving machine comprises at least one bending unit associated to the support bench and configured to bend the bars.

The support bench can be equipped with guides that cooperate at least with the at least one bending unit, which is equipped to move along the support bench in a desired and controlled manner.

When the clamping means are located centrally with respect to the length of the support bench, they can be substantially stable and suitable to clamp the bars.

According to a variant the clamping means can be totally or partly retracted with respect to the support bench.

According to another variant it can be provided that it is a bending unit that performs the function of the clamping means, at least temporarily. In this case, the bending unit can be located centrally to the support bench, or in a desired position, even terminal.

The bending unit has two contrast rolls between which the bars are gripped.

The bending unit also comprises a curving roll that cooperates with guide means and with a positioning device, in order to selectively position, either continuously or point-by-point, the curving roll on the bar or bars to be processed.

In particular, the curving roll acts on the bar, thrusting it to bend it around one of the contrast rolls.

A programmable computerized system controls, commands and manages the whole.

BRIEF DESCRIPTION OF THE SEVERAL VIEWS OF THE DRAWINGS

These and other characteristics of the present invention will become apparent from the following description of some forms of embodiment, given as a non-restrictive example with reference to the attached drawings wherein.

DETAILED DESCRIPTION OF THE INVENTION

Figure 1:
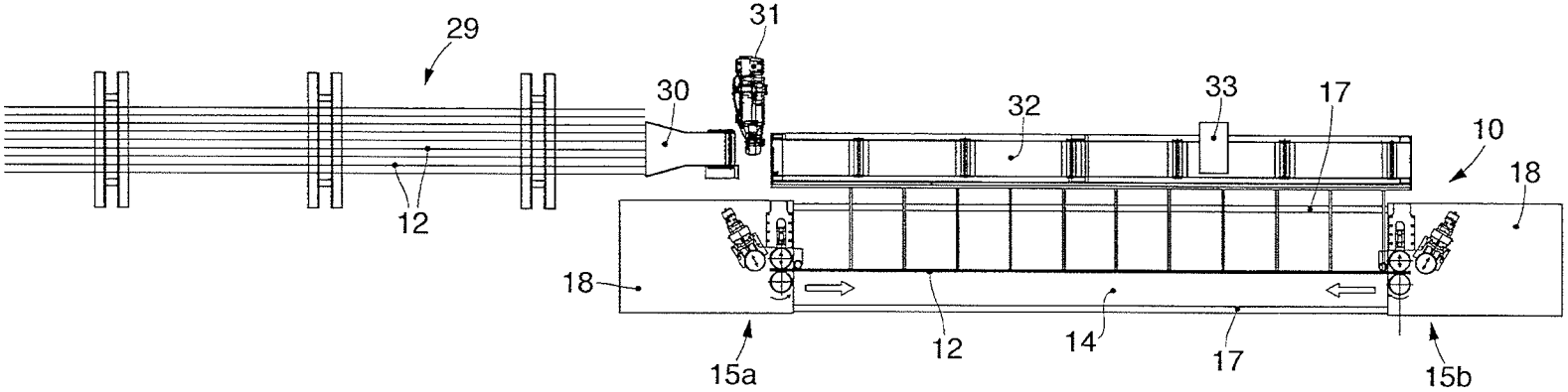
FIG. 1 shows a perfected curving machine according to the invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

In accordance with the present invention, a perfected curving machine 10 is shown schematically in FIG. 1 and is configured to curve, shape or bend bars 12 with different characteristics and nominal diameters.

The curving machine 10 is configured to operate on one or more bars 12 according to the particular working needs required.

Here and hereafter in the description reference will be made to the working of a single bar 12 although it is clear that the curving machine can work more bars 12 at the same time.

The curving machine 10 comprises a support bench 14 provided to support the bar 12 during working.

The support bench 14 has a mainly oblong development and a length substantially equal to the length of the bars 12 that it has to support.

The support bench 14 can be located substantially horizontal or sub-horizontal, although a vertical orientation thereof is not excluded.

The curving machine 10 also comprises at least one bending unit, in this case two bending units 15*a* and 15*b* configured to bend the bar 12 to the desired shape.

The bending units 15*a* and 15*b* are installed on respective movement carts 18 which are configured to move the bending units 15*a* and 15*b* along an axis of movement X.

Figure 2:
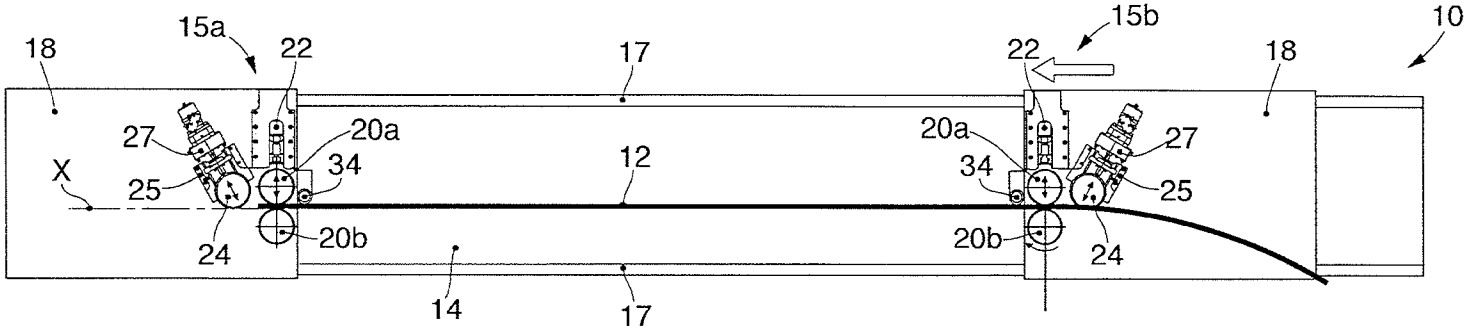
FIG. 2 shows the curving machine of FIG. 1 in a first operating position.

In the form of embodiment of FIGS. 1 and 2, the bending units 15*a* and 15*b* are disposed aligned along the axis of movement X and can be moved reciprocally nearer to and away from each other.

The axis of movement X develops substantially along the longitudinal development of the support bench 14.

The carts 18 can be moved on the support bench 14 in a desired and controlled manner, each cart 18 being managed by itself or in relation to the other cart 18.

In accordance with a possible solution, the curving machine 10 comprises movement members associated to the carts 18 to allow the latter to move on the support bench 14.

The movement members, not shown in the drawings, can include grub screw mechanisms, rack or chain mechanisms.

In accordance with a possible form of embodiment, the curving machine 10 comprises guides 17 disposed substantially parallel to the axis of movement X and on which the carts 18 are installed sliding.

Each bending unit 15*a* and 15*b* comprises two contrast rolls 20*a* and 20*b*, located in a position opposite each other and during use, the bar 12 is made to pass between them.

At least one of the contrast rolls, in this case the contrast roll 20*a* is provided with positioning means 22 configured to allow contrast roll 20*a* to move selectively nearer to/away from contrast roll 20*b*, in order to adjust the gap of the bar 12 and hence the pressure that the contrast rolls 20*a* and 20*b* exert on the bars 12. The pressure exerted on the bars 12 can be intended to draw the bar 12 or, in a possible variant, to exert a holding or clamping action on the bar 12.

In possible solutions, at least one of the bending units 15*a*, 15*b*, in this case both, also perform the function of clamping means on the bar 12.

In this form of embodiment, it is provided to constrain the rotation of the contrast rolls 20*a* and 20*b* and to press them one against the other to exert a holding action on the bar 12.

According to a possible solution, at least one of the contrast rolls, in this case the contrast roll 20*b*, is motorized.

This solution allows to move the respective bending unit 15*a* or 15*b* along the extension of the bar 12 in order to allow the bends to be made, as will become clear hereafter.

In this solution, it may not be necessary for the cart 18 to be motorized, at least during the working step of the bars 12, since the action of the motorized contrast roll 20*b* on the bars 12 determines the controlled and desired advance of the cart 18.

Indeed, the contrast roll 20*b*, acting on the bar 12, exerts a friction action with the contrast roll 20*a* on the bar 12 and draws with it the corresponding bending unit 15*a* and 15*b* and the cart 18.

The bending units 15 also comprise, in cooperation with the contrast rolls 20*a* and 20*b*, at least a curving roll 24 configured to exert a predefined deformation on the bar 12 comprised between the contrast rolls 20*a* and 20*b*. The curving roll 24 is located in an external position with respect to the contrast rolls 20*a* and 20*b*.

In particular, the curving roll 24 determines a predefined curvature of the bar 12 around at least one of the contrast rolls 20*a*, and 20*b*.

The curving roll 24 can be associated to guide means 25 and to a positioning device 27, configured to move the curving roll 24, with respect to the contrast rolls 20*a*, 20*b*, on the guide means 25.

The guide means 25 can be disposed with an orientation incident with the axis of movement X, that is, incident with the bar 12 so as to allow the curving roll 24 to exert the desired curving action.

The positioning of the curving roll 24 can be continuous and/or discrete.

The position of the curving roll 24 with respect to the contrast rolls 20*a* and 20*b* determines the curvature of the bar 12.

Indeed the curving roll 24 can remain fixed with respect to the contrast rolls 20*a* and 20*b* all the time the bar 12 is worked, or, according to a variant and in the case of curvatures with different radiuses, the position of the roll 24 is updated on each occasion, with respect to the contrast rolls 20*a* and 20*b*, by commands imparted by the positioning device 27 of the curving roll 24.

The position of the curving roll 24 can be fixed, for example orthogonal to the bar 12, or inclined with respect to it by a different and variable angle in relation to the desired radius of curvature of the bar 12.

In other variants of the invention, the position of the curving rolls 24 is the same for both bending units 15*a* and 15*b*, or different from each other, for example to obtain an arc of a circle with different curvature values.

In other variants, the position of the curving rolls 24 is variable in a discontinuous manner during the shaping operations.

Figure 8:
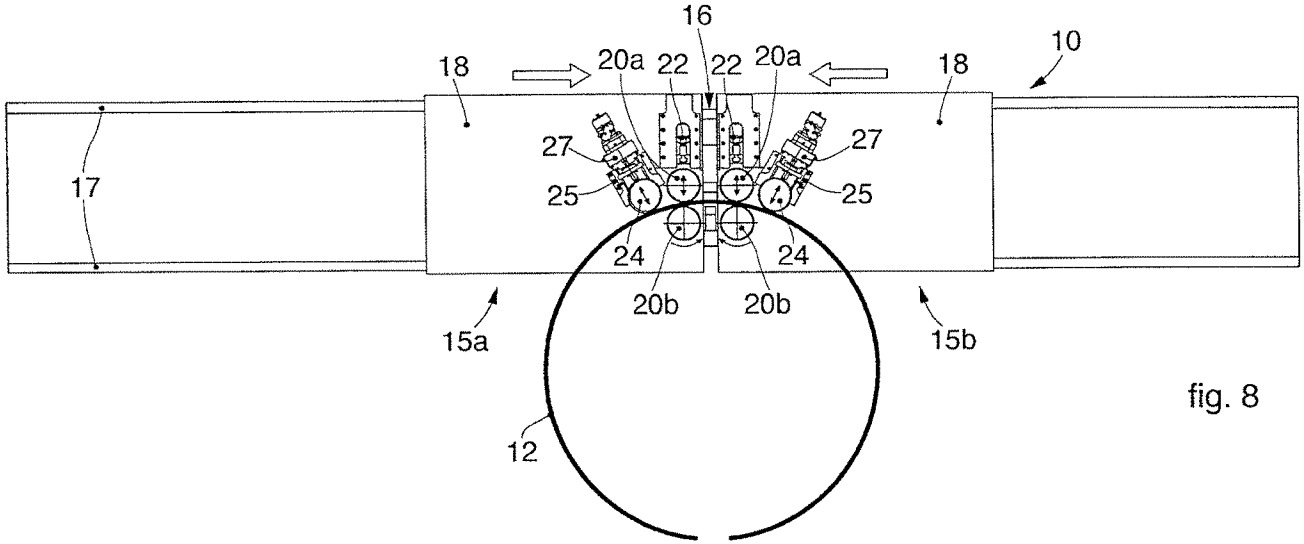
FIG. 8 shows the curving machine of FIG. 5 in a third operating position.
Figure 9:
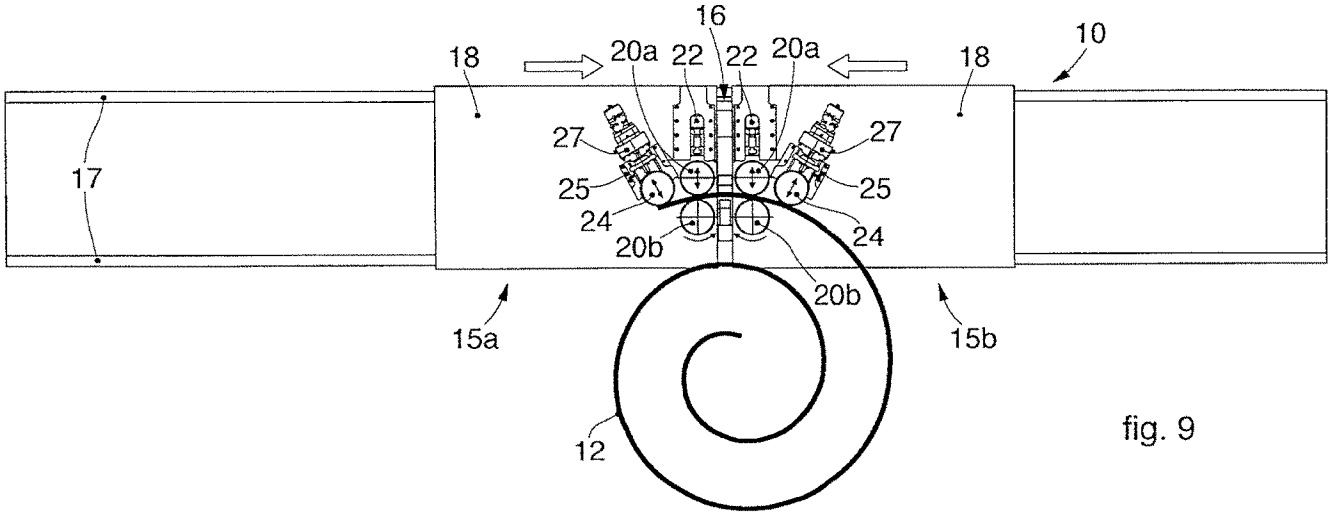
FIG. 9 shows the curving machine of FIG. 5 in a fourth operating position.

In the form of embodiment shown in FIGS. 8 and 9, the position of the curving roll 24 is variable in continuous manner during the working of the bars 12.

In accordance with one possible implementation, each of the bending units 15*a* and 15*b* can comprise an abutment roll 34, disposed with respect to the bar 12, on the same side on which the curving roll 24 is located.

The abutment roll 34 is positioned in a fixed position with respect to the cart 18 for moving the bending unit 15*a*, 15*b*.

In each bending unit 15*a* and 15*b*, the abutment roll 34 is disposed so that the contrast rolls 20*a*, 20*b* are interposed between the abutment roll 34 and the curving roll 24. In this way, when the bar 12 is bent by the curving roll 24, the portion of bar located upstream of the curved portion that is made does not move, rendering the action of the curving roll 24 null.

According to a possible variant, not shown in the drawings, at least one of the bending units 15*a* and 15*b* is provided with clamping means installed on board the respective cart 18 and configured to constrain the position of the bar 12 to that of the respective bending unit 15*a*, 15*b*.

According to a variant of the invention (FIG. 6), the curving machine 10 comprises clamping means 16 interposed between the bending units 15*a* and 15*b* and configured to clamp the bar 12 at least during shaping.

The clamping means 16 can comprise a vise for example.

According to the invention, the action of the clamping means 16 can be regulated depending on the desired clamping.

According to a possible solution, the clamping means 16 can be vertically fixed or retractable with respect to the support bench 14, to move to a position of non-interference with a possible movement of the bar 12 during loading or discharge of the shaped bar 12.

According to the forms of embodiment shown in FIGS. 1-5, the curving machine 10 comprises bending units, respectively 15*a* and 15*b*, which alternately perform the function of clamping means.

Figure 3:
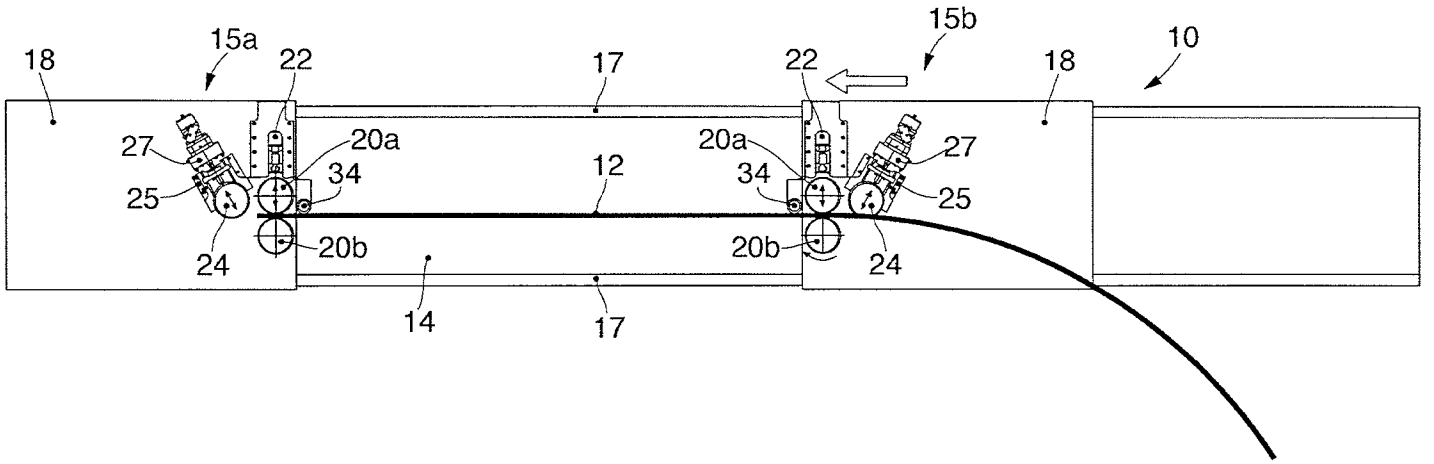
FIG. 3 shows the curving machine of FIG. 1 in a second operating position.
Figure 4:
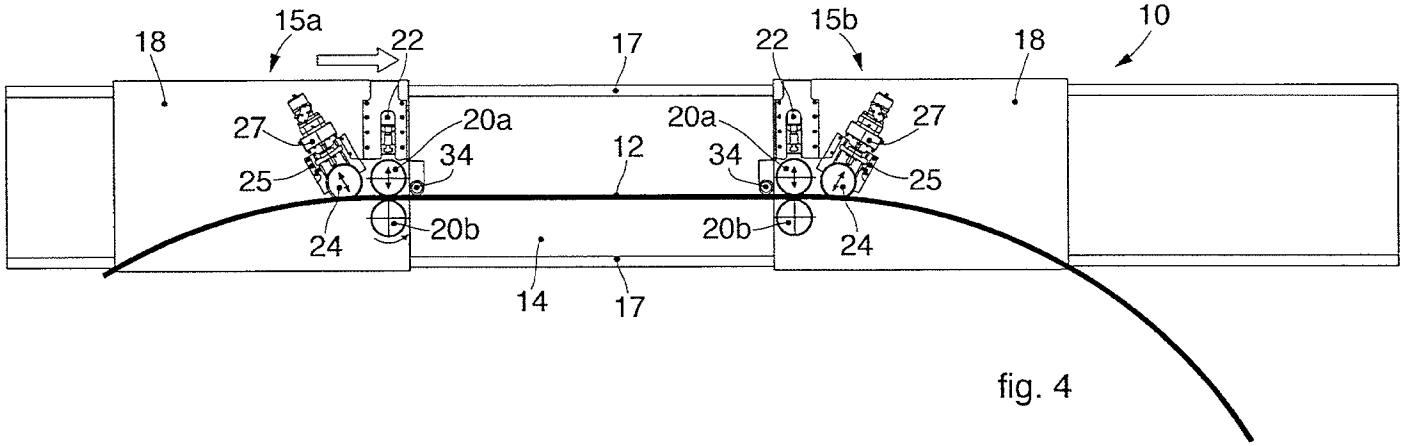
FIG. 4 shows the curving machine of FIG. 1 in a third operating position.
Figure 5:
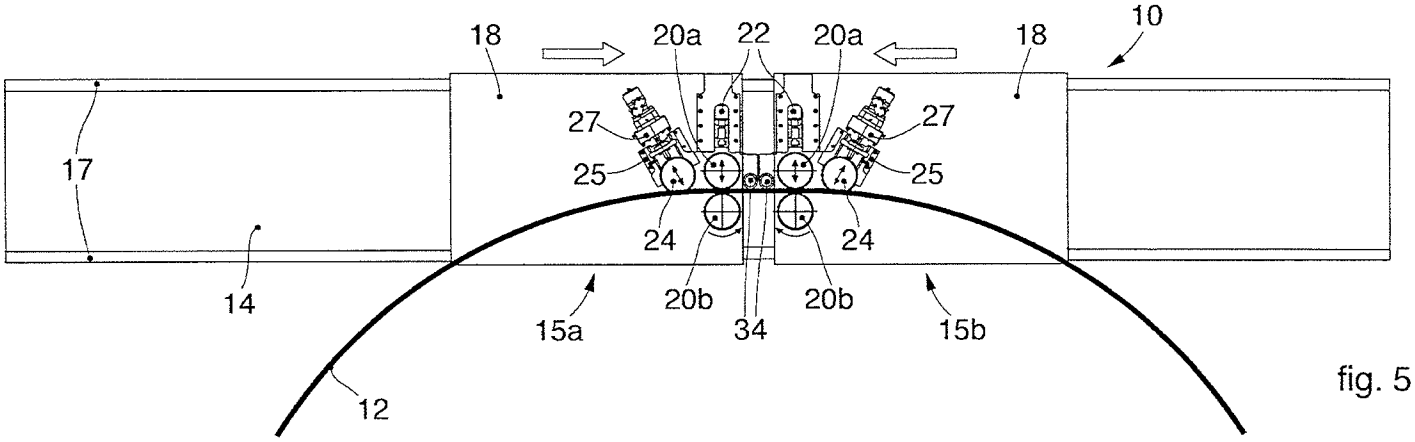
FIG. 5 shows the curving machine of FIG. 1 in a final operating position.

In this solution, the following operating modes can be achieved:

- the bending unit 15*a* remains stationary at one end of the guides 17 and acts as a vise while the bending unit 15*b* advances (FIG. 2) at least as far as half the bar 12, bending it into one or more predetermined bends, and then stops to assume the function of the clamping means (FIG. 3). When the bending unit 15*b* is stationary, the bending unit 15*a* advances (FIG. 4), possibly bending the bar 12 until it substantially comes into contact with the bending unit 15*b* (FIG. 5). In this way, both the bending units 15*a* and 15*b* obtain the corresponding bent portions of the bar 12;
- the bending unit 15*a* moves to an intermediate position along the extension of the bar 12 and acts as a vise, and the bending unit 15*b* advances along the bar 12, bending it in a desired manner until it almost comes into contact with unit 15*a*. After this, it will be the bending unit 15*a*, possibly and if required, to move to the desired position to perform another bend.

Figure 6:
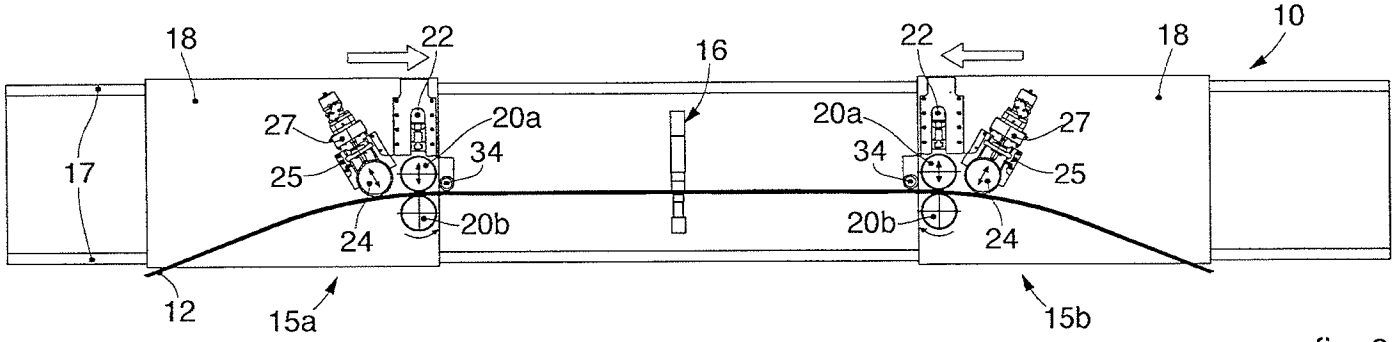
FIG. 6 shows a variant of the curving machine of FIG. 1 in a first operating position.
Figure 7:
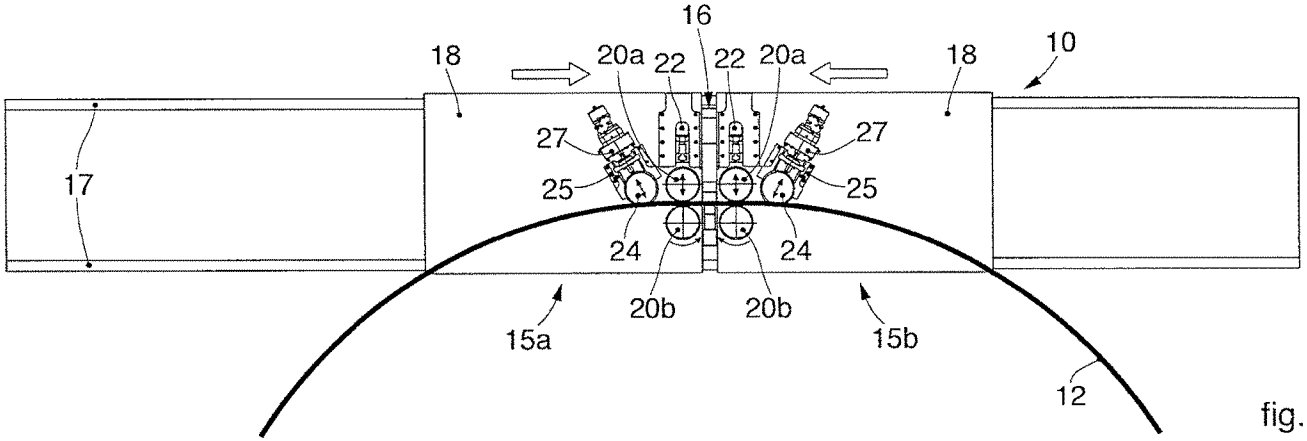
FIG. 7 shows the curving machine of FIG. 5 in a second operating position.

In the solution shown in FIGS. 6-7, the clamping means 16 are disposed in an intermediate position along the longitudinal extension of the support bench 14.

In this solution, the bending units 15*a* and 15*b* advance simultaneously from the ends of the support bench 14 toward the clamping means 16, where they stop (FIG. 7). During their movement, the bending units 15*a* and 15*b* perform the corresponding curving operations, since the bar 12 is clamped by the clamping means 16.

By suitably regulating the action of the bending units 15*a*, 15*b*, it is possible to obtain bars 12 shaped in a circle (FIG. 8) or, if the reciprocal position between the curving roll 24 and the contrast rolls 20*a* and 20*b* is continuously modified, for example a spiral shape is obtained (FIG. 9).

In the form of embodiment in FIG. 1, the curving machine 10 comprises a bar feed unit 29, in which the bars 12, pre-cut or not, are disposed in the form of bundles.

The bar feed unit 29 can also comprise an extractor 30 to take one or more bars 12 from the bar feed unit 29 to then make them available on the support bench 14 to the bending units 15*a* and 15*b*.

Downstream of the extractor 30 there is a cutting element 31, such as a shear, to selectively cut the one or more bars 12 to a desired length.

Subsequent to the cutting element 31 a feed bench 32 is disposed, which develops longitudinally and adjacent to the support bench 14 to feed the bars 12 to the latter.

A drawing unit 33 is also associated with the feed bench 32, operating in cooperation with the extractor 30, and provided to extract the individual bars 12 from the bar feed unit 29.

The drawing unit 33 is selectively mobile with respect to the feed bench 32 to take the bars 12 extracted by the extractor 30 and take them to the feed bench 32.

A measuring device can cooperate with the drawing unit 33, for example integrated with the cutting element 31 or, alternatively, with the drawing unit 33. The measuring device is configured to selectively command the functioning of at least one of either the extractor 30, the cutting element 31 or the drawing unit 33.

It is clear that modifications and/or additions of parts may be made to the perfected curving machine 10 and the corresponding method as described heretofore, without departing from the field and scope of the present invention.

Figure 10:
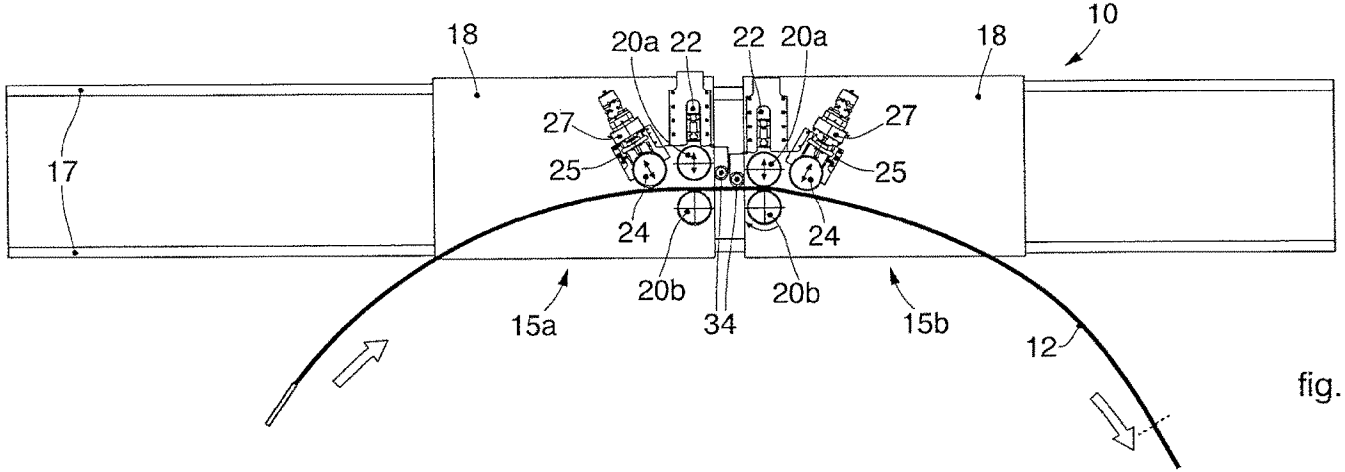
FIG. 10 shows a possible operating position of the curving machine of FIG. 1.

For example, as shown in FIG. 10, it can be provided that in at least one of the two bending units 15*a* and 15*b*, the curving roll 24 and the contrast roll 20*a* adjacent to it, and located on the same side with respect to the bar 12, are selectively movable away from the other contrast roll 20*b*.

In this way, in the condition where the first bending unit 15*a* and the second bending unit 15*b* are in contact with each other, the curving roll 24 and the contrast roll 20*a* of one of the bending units, in this case the first bending unit 15*a*, moves away from the contrast roll 20*a*. In this condition, the rolls of the other bending unit 15*b* are activated and in particular the motorized contrast roll 20*a* determines an advance of the bar 12 in order to complete the bending of the segment of bar 12 that is comprised between the first 15*a* and the second bending unit 15*b*.

According to a possible formulation of the present invention, it can be provided that, once bending has been completed, and if it has not been done correctly, the curving rolls 24 are taken to a position of non-interference with the bar 12 and the bending units 15*a* and 15*b* are moved reciprocally away from each other, keeping the respective contrast rolls 20*a* and 20*b* in contact with the bar 12. In this way, it is possible to straighten the bar 12 already bent, so as to possibly perform the bending operation again.

It is also clear that, although the present invention has been described with reference to some specific examples, a person of skill in the art shall certainly be able to achieve many other equivalent forms of perfected curving machine 10 and the corresponding method, having the characteristics as set forth in the claims and hence all coming within the field of protection defined thereby.

I claim:

1. A perfected curving machine comprising a support bench configured to simultaneously support one or more bars, wherein said support bench has an oblong development in relation to a length of the one or more bars, and wherein said curving machine comprises at least one bending unit controllably mobile along said support bench and along said one or more bars in order to bend said one or more bars, and clamping means configured to constrain the position of said one or more bars on said support bench, wherein the at least one bending unit comprises two contrast rolls with adjustable interaxes and the one or more bars pass between and are gripped by the two contrast rolls, wherein the at least one bending unit further comprises a curving roll adjustable with respect to the one or more bars and to the two contrast rolls, and the curving roll determines a predefined curvature of the one or more bars around one of the two contrast rolls as the at least one bending unit is moved along the support bench, wherein said machine further comprises guide means having an orientation incident with an axis of movement of the one or more bars along the support bench, and the orientation of the guide means determines the curving action of the curving roll and a positioning device on said guide means, wherein the positioning device is configured to move the curving roll with respect to the contrast rolls.

2. The curving machine as in claim 1, wherein said clamping means constrains the position of the bar to that of the respective bending unit.

3. The curving machine as in claim 2, wherein the at least one bending unit has two or more bending units that alternately perform a clamping function of the clamping means.

4. The curving machine as in claim 1, wherein the clamping means comprise an adjustable vise to clamp the one or more bars, wherein the adjustable vise is vertically fixed or retractable with respect to said support bench.

5. The curving machine as in claim 4, wherein the vise is vertically fixed with respect to said support bench.

6. The curving machine as in claim 4, wherein the vise can be retractably moved with respect to said support bench.

7. The curving machine as in claim 1, wherein the at least one bending unit move in an independent manner along said support bench.

8. The curving machine as in claim 1, wherein each of said at least one bending unit comprises an abutment roll disposed, with respect to the one or more bars, on the same side where the curving roll is located, said abutment roll being disposed in each bending unit in such a manner that the contrast rolls are interposed between the abutment roll and the curving roll.

9. The curving machine as in claim 1, wherein at least one of the two contrast rolls is motorized.

10. The curving machine as in claim 1, wherein each of the at least one bending unit is installed on carts slidable on guides along an axis of movement.

11. The curving machine as in claim 1, wherein the curving roll is a connected to the positioning device configured to move the curving roll.

12. A curving method, comprising:

positioning at least one bar on a support bench having an oblong development;

passing said at least one bar between two contrast rolls, wherein the two contrast rolls grip the at least one bar;

constraining a position of said at least one bar on said support bench with clamping means;

controllably moving at least one bending unit, comprising the at least two contrast rolls and a curving roll, along said support bench and along said at least one bar; and curving the at least one bar in a predefined curvature around one of said contrast rolls by moving said curving roll with respect to the contrast rolls and towards said at least one bar by a positioning device on guide means, wherein said guide means are disposed with an orientation incident with an axis of movement that develops along the oblong development of the support bench, and the guide means determine a curving action of the curving roll.

13. The curving method of claim 12, wherein at least one of said contrast rolls is motorized and action of the motorized contrast roll on the at least one bar determines a controlled advance of a cart on which the at least one bending unit is installed, wherein the cart is moveable on the bench.

* * * * *